United States Patent [19]

Durrant et al.

[11] 3,937,024

[45] Feb. 10, 1976

[54] CONTROL SYSTEM FOR A TWO BOILER, SINGLE TURBINE GENERATOR POWER PRODUCING UNIT

[75] Inventors: Oliver W. Durrant, Bath Township; John William Smith, Massillon, both of Ohio

[73] Assignee: The Babcock & Wilcox Company, New York, N.Y.

[22] Filed: Aug. 7, 1974

[21] Appl. No.: 495,314

Related U.S. Application Data

[62] Division of Ser. No. 367,775, June 7, 1973.

[52] U.S. Cl. ..... 60/676; 122/451 R

[51] Int. Cl.[2] ..... F01K 13/00

[58] Field of Search ..... 60/664, 665, 676; 122/451 R, 448 B

[56] References Cited

UNITED STATES PATENTS

| | | | |
|---|---|---|---|
| 2,643,520 | 6/1953 | Powell, Jr. | 122/448 B |
| 3,244,898 | 4/1966 | Hickox | 122/451 R |

*Primary Examiner*—Martin P. Schwadron
*Assistant Examiner*—H. Burks, Sr.
*Attorney, Agent, or Firm*—John F. Luhrs

[57] ABSTRACT

A coordinated control system for a power producing unit consisting of two, single reheat steam generators supplying steam to a single turbine-generator.

6 Claims, 9 Drawing Figures

SYSTEM ORGANIZATION

RATIO CONTROL (FEEDWATER CONTROL)

(REHEAT FLOW CONTROL)

FIRING RATE CONTROL

CONTROL SYSTEM FOR A TWO BOILER, SINGLE TURBINE GENERATOR POWER PRODUCING UNIT

This is a division of application Ser. No. 367,775 filed June 7, 1973.

This invention relates to a coordinated control system for large size electric power producing units such as found in modern central stations. As an order of magnitude such units may, for example, be rated at upwards of 1000 MW requiring, at full load, over 6,000,000 pounds of primary steam per hour at 2500 psig and 1000 F. Customarily, in such units, the steam passes first through a high pressure turbine, thence through a reheater pass in the steam generator wherein the steam is raised to a hot reheat temperature of approximately 1000 F., and thence through a low pressure turbine to a condenser.

To improve the reliability of such power producing units and to maintain a reasonable steam generator size it has recently been proposed to satisfy the total steam demand of the turbine by providing the unit with two steam generators operating in parallel. Such a combination of two steam generators, single turbine generator presents unique control problems as will be evident from the detailed description to follow. It is to the solution of these problems that our invention is addressed. It will be apparent, however, that our novel control system incorporates features equally applicable to the more common single turbine generator - single steam generator arrangement.

In accordance with our invention the total output of the two steam generators is maintained primarily in accordance with the unit MW or energy demand as established by an automatic load dispatch system or otherwise.

Further, in accordance with our invention, the unit energy demand may be apportioned between the two steam generators as desired.

Further, in accordance with our invention, if the output of one steam generator is limited, the output of the other steam generator is automatically increased as required to satisfy the unit energy demand.

Further, in accordance with our invention, if the total available output of the two steam generators is insufficient to satisfy the unit energy demand, the demand is reduced to be compatible with the total available output.

Further, in accordance with our invention, feedwater, fuel and air are supplied each steam generator primarily in accordance with the proportion of unit energy demand allocated to the steam generator.

Further, in accordance with our invention, the total reheat steam flow from the turbine is apportioned between the two steam generators primarily in accordance with the share of the unit energy demand allocated to the steam generator.

These and further objectives of our invention will be apparent as the description proceeds in connection with the drawings, in which:

IN THE DRAWINGS

DETAILED DESCRIPTION

Figure 1:
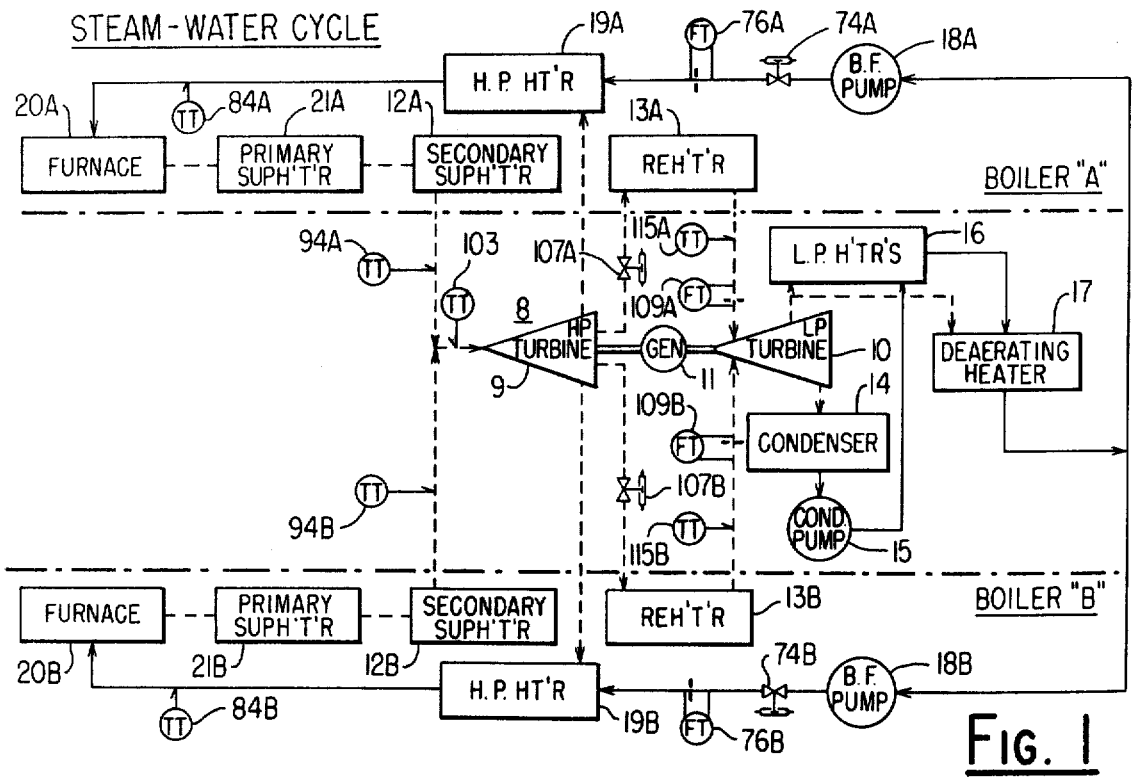
FIG. 1 is a block diagram of the basic steam-water flow cycle of a typical power producing unit having two single reheat steam generators supplying steam to a turbine.

Referring now to FIG. 1, we therein show the elementary steam-water cycle for a more or less typical two boiler-single turbine generator power producing unit comprising steam generators, or boilers as they are sometimes called, A and B, a common turbine generator unit generally indicated at 8 having a high pressure turbine 9 and a low pressure turbine 10. As shown both high pressure and low pressure turbines may drive a single generator 11, or each turbine may drive a separate generator both feeding into a common bus. The particular arrangement of turbine and generator which may be used forms no part of our present invention. Steam discharged from secondary superheaters 12A and 12B of steam generators A and B respectively passes through high pressure turbine 9, is then divided, part passing through reheater 13A and the remainder through reheater 13B. The hot reheat steam from reheater 13A and 13B then passes through low pressure turbine 10 and is discharged into condenser 14. What is shown as a low pressure turbine may in actual practice be an intermediate pressure turbine and one or more low pressure turbines.

Condensate from condenser 14 is pumped by condensate pump 15 through low pressure heaters 16, heated by extraction steam from low pressure turbine 10, into the deaerating heater 17, also heated by extraction steam from low pressure turbine 10. Feedwater for boiler A is drawn from the deaerating heater 17 by a boiler feed pump 18A and is discharged through high pressure heater 19A into boiler A having a furnace 20A, a primary superheater 21A and into secondary superheater 12A. Feedwater for boiler B is also drawn from deaerating heater 17 by a boiler feed pump 18B and discharged through high pressure heater 19B into boiler B having a furnace 20B, primary superheater 21B and into secondary superheater 12B.

Figure 2A:
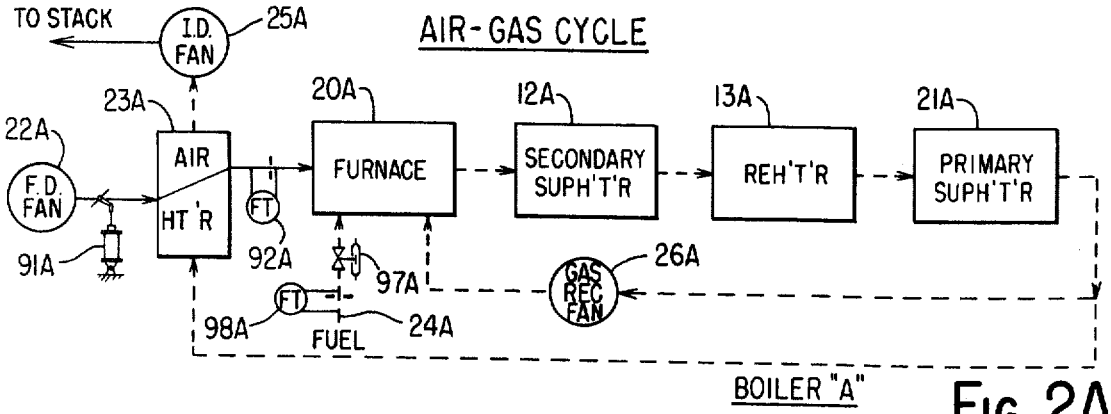
FIG. 2A is a block diagram of the basic air-gas flow cycle of steam generator A shown in FIG. 1.
Figure 2B:
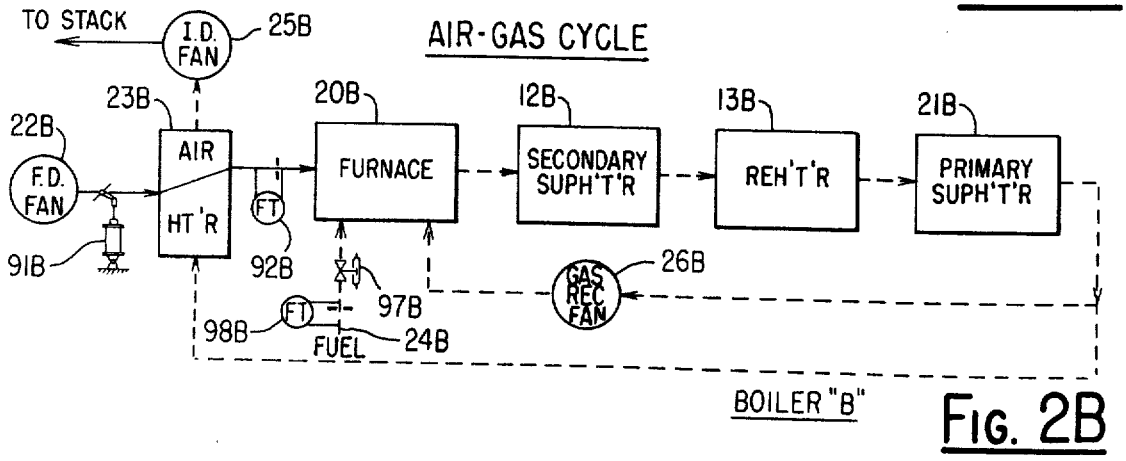
FIG. 2B is a block diagram of the basic air-gas flow cycle of steam generator B shown in FIG. 1.

In FIGS. 2A and 2B are shown the air-gas cycles for boilers A and B respectively. The cycles are identical and in the interest of brevity that for boiler A only will be traced. Components for the boiler A in FIG. 2A being identified by a number followed by the letter — A — and like components for the boiler B in FIG. 2B being identified by the same number followed by the letter — B —.

Referring to FIG. 2A, air for combustion supplied by a forced draft fan 22A passes through air heater 23A and is discharged into furnace 20A. Fuel, which may be oil, gas, coal or a combination thereof, is discharged into the furnace 20A from any conventional supply means (not shown, but schematically represented by the line 24A). The gasses of combustion, or flue gas, as it is commonly called, leaving the furnace pass through secondary superheater section 12A, reheater section 13A, primary superheater section 21A, air heater 23A and induced fan 25A whence they are discharged to the atmosphere through a stack (not shown). Flue gas leaving the primary superheater 21A may also be recirculated into the furnace 20A by gas recirculating fan 26A as a means of partially or wholly controling reheat steam temperature. In general, the rate of flow of recirculated gas is maintained in inverse proportion to heat or energy input to the boiler. The order shown in which the products of combustion pass over the several heating sections is not the exclusive order. The order may be, for example, primary superheater, secondary superheater, and reheater; or secondary superheater, primary superheater, and reheater. Likewise, an economizer section may be included in the order at an appropriate place.

SYSTEM ORGANIZATION (FIG. 3)

Figure 3:
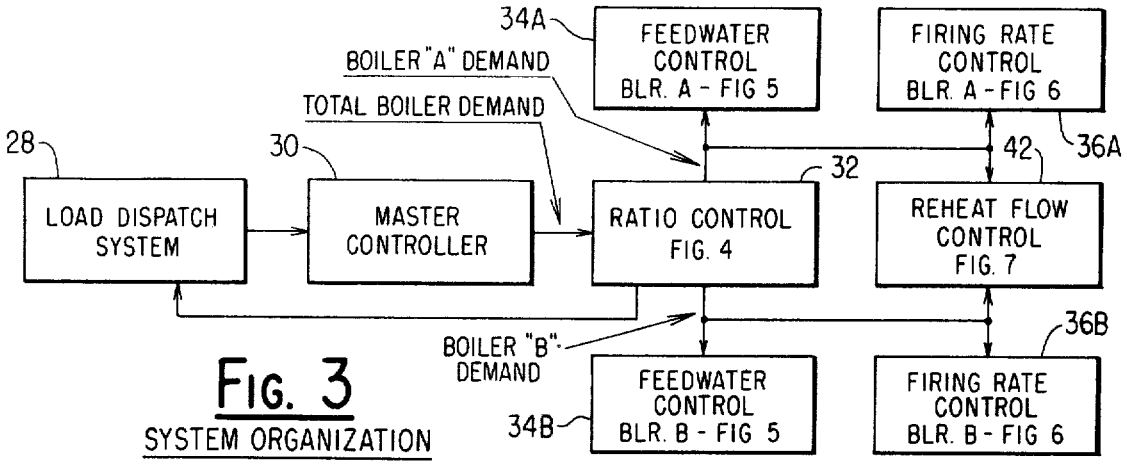
FIG. 3 is a block diagram of the control system organization.

FIG. 3 shows, in block diagram, the organization of the control system. The unit load demand may be established by an automatic load dispatch system, as shown at 28, or by other automatic or manual means. It is the purpose of this control to generate a control signal corresponding to the desired energy output as may be measured in MW, BTU or other energy units. The control signal so generated is transmitted to a master controller 30 which may be any one of the several types now more or less common in the art. One particular suitable type being illustrated and described in Chapter 35 of the thirty eighth edition of "Steam" published by The Babcock & Wilcox Company. It is the primary purpose of the master controller to generate, from the control signal established by the load dispatch system 28, a control signal to the steam generators whereby the actual energy output of the power producing unit will be maintained equal to the desired energy output. The control signal generated in master controller 30 is transmitted to a ratio controller 32, the purpose of which is to apportion the total load demand between steam generators A and B as desired within the capabilities of the generators. That is to say, it divides the control signal from master controller 30 and establishes a first demand signal for the boiler A and a second demand signal for the boiler B. The first demand signal, as shown, is utilized in a feedwater control 34A and firing rate control 36A of boiler A. Similarly, the second demand signal is utilized in the feedwater control 34B and firing rate control 36B of boiler B. The two demand signals generated in ratio control 32 are also transmitted to a reheat flow control 42, the purpose of which is to apportion the flow of reheat steam to boilers A and B primarily in proportion to boiler load.

Figure 4:
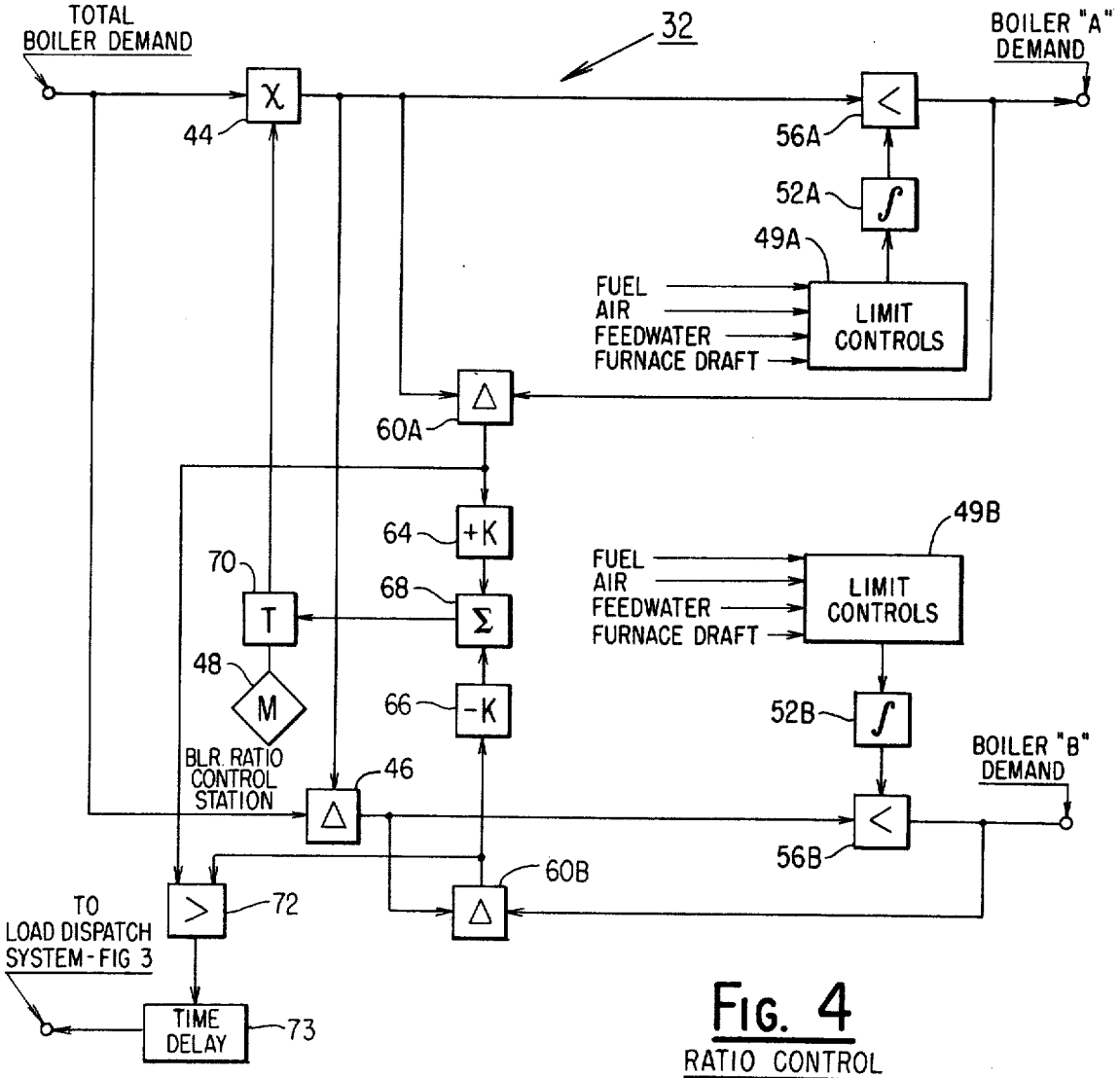
FIG. 4 is a logic diagram showing in detail the ratio control identified in FIG. 3 by the block 32.
Figure 5:
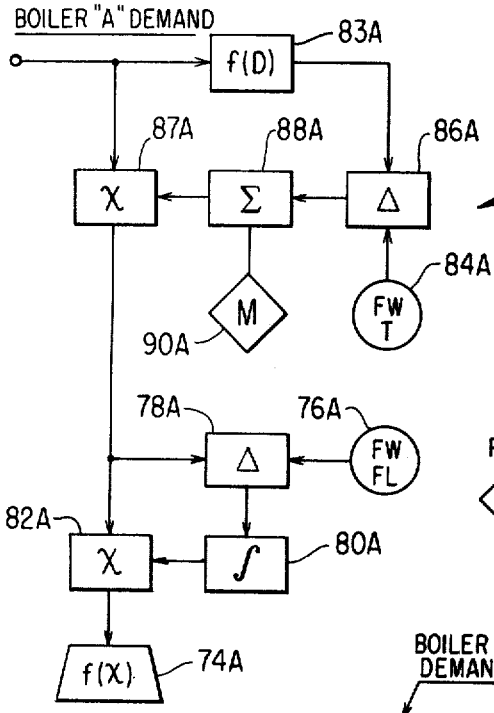
FIG. 5 is a logic diagram showing in detail the feedwater flow control for each of the steam generators A and B identified in FIG. 3 by blocks 34A and 34B respectively.
Figure 7A:
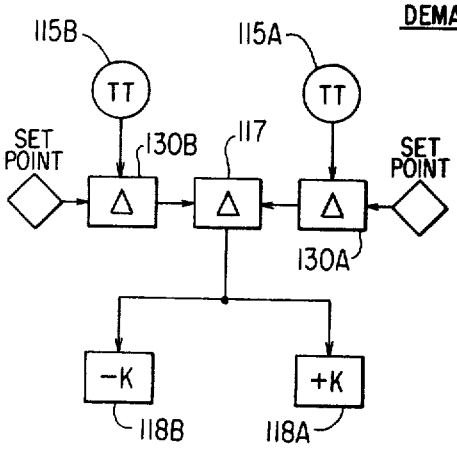
FIG. 7A is a fragmentary logic diagram showing a modification of the reheat steam control illustrated in FIG. 7.
Figure 7:
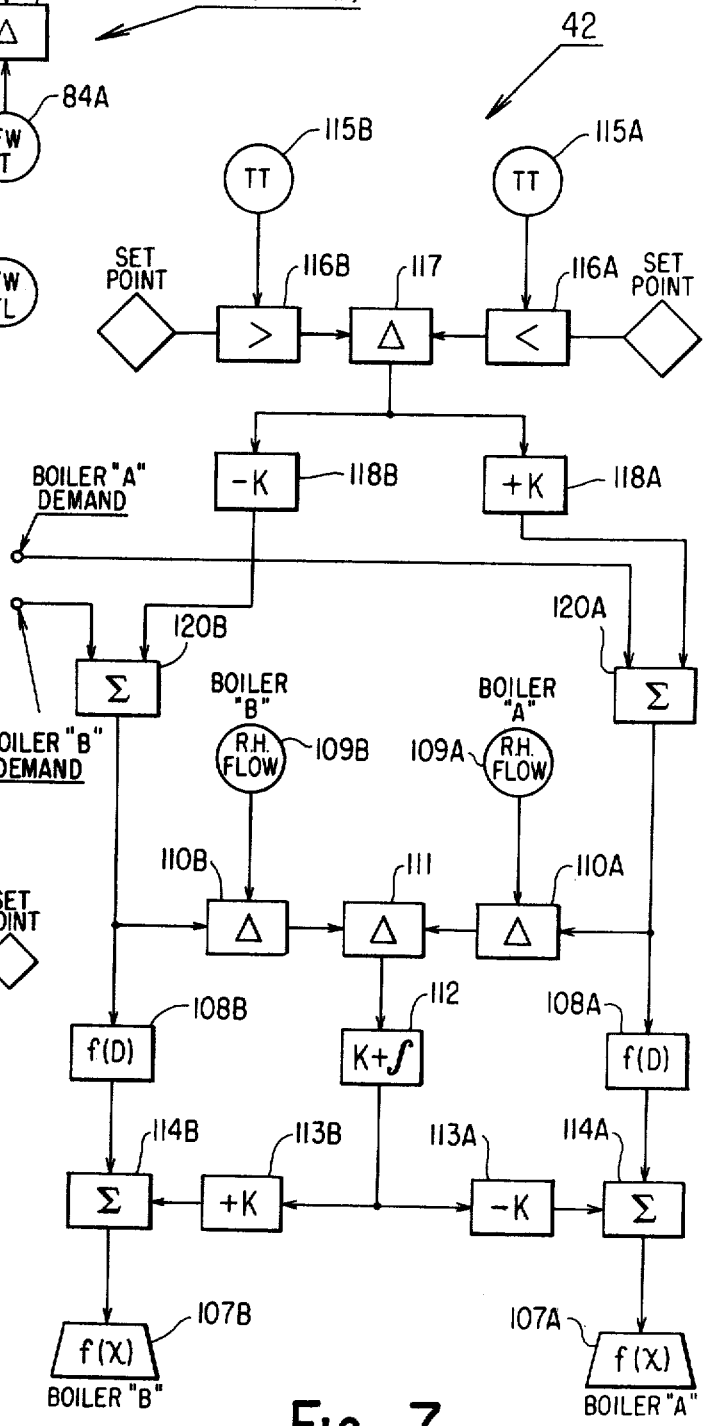
FIG. 7 is a logic diagram showing in detail the reheat steam control identified in FIG. 3 by block 42.

FIGS. 4, 5, and 7 show the ratio, feedwater, firing rate and reheat flow control for boilers A and B. In reference to these figures it should be noted that conventional control logic symbols have been used. The control components or hardware, as it is sometimes called, which such symbols represent, are commercially available and their operation well understood by those familiar with the art. Furthermore, we have used conventional logic symbols to avoid identification of the control system with any particular type of control, such as pneumatic, hydraulic, electronic, electric or a combination of these, as the invention may be incorporated in any one or a combination of these types. The primary controllers shown in FIGS. 4, 5, 6 and 7 have been referenced into FIGS. 1, 2A, and 2B as have the final control elements.

RATIO CONTROL (FIG. 4)

Referring to FIG. 4, the control signal corresponding to total boiler demand, as generated by master controller 30 (FIG. 3) is transmitted to a multiplying unit 44, the output signal from which is transmitted to a difference unit 46. That portion of total boiler demand that each boiler should assume is established in ratio control station 48 which generates a control signal transmitted to multiplier 44. The output signal from multiplier 44 is thus the demand signal to boiler A. In the difference unit 46 the boiler A demand signal is subtracted from the total boiler demand signal and the output signal therefrom is the boiler B, demand signal.

In the event one or more factors in the operation of either boiler A or boiler B is limited or exceeds a predetermined limit it is necessary that the demand signal to the boiler be limited accordingly. Representative of factors, the supply of which places a limitation on boiler output are fuel flow, air flow, feedwater flow, reheater flow and superheater flow during by-pass operations. Representative of factors, which if exceeding a predetermined limit places a limitation on boiler output is furnace draft which may exceed a predetermined positive limit in the event the capacity of the induced draft fan is limited. The factors mentioned are to be taken as merely representative of the many factors which can place a limitation on boiler capacity.

As shown in FIG. 4 such factors as are deemed critical generate signals forming the inputs to a limit control 49A for boiler A and a similar limit control 49B for boiler B. To avoid momentary and small excursions beyond predetermined limits needlessly constraining boiler demand excursions less than a 5% deadband are ignored. Following a sustained excursion beyond 5%, however, the deadband error signal is reduced to 1% so that errors less than 1% only are ignored. The demand signal to the boiler is then run back to bring it into congruence with the constrained boiler capacity. The output signals from limit controls 49A and 49B are integrated with respect to time in integrating units 52A and 52B and then transmitted to low selectors 56A and 56B respectively. It is therefore the signal from multiplier 44 or the signal from integrator 52A, whichever is the lessor, which is the actual demand signal to boiler A. Similarly, it is the signal from difference unit 46 or the signal from integrator 52B, whichever is the lessor, which is the actual demand signal to boiler B.

Notwithstanding that a constraint is placed on the output of one boiler, it is desirable that the total output of the two boilers should satisfy the unit energy demand. Accordingly, our invention comprehends in the event the output of one boiler is limited, to automatically compensate therefor by increasing the output of the other boiler. To this end a difference unit 60A generates a signal proportional to the difference between the output signal of multiplier 44 and low signal selector 56A which is transmitted through direct proportional unit 64 to a summing unit 68. Similarly, a difference unit 60B generates a signal proportional to the difference between the output signal of difference unit 46 and low signal selector 56B which is transmitted through reverse proportional unit 66 to the summing unit 68.

If both boilers A and B are carrying their assigned loads, i.e. if the output of neither one is limited, the output signal generated by summing unit 68 ill be at neutral. In the event the output of boiler is limited, the output signal from summing unit 68 operates a transfer unit 70 and thereafter serves as the input signal to multiplier 44. As the output signal from multiplier 44 changes in a direction to bring it into equality with the output signal from integrating unit 52A, the demand signal to boiler B will be increased accordingly through operation of difference unit 46.

A constraint on the output of boiler B operates in similar fashion, the output signal from reverse proportional unit 66 operating through summing unit 68 and transfer unit 70 to increase the demand signal to boiler A and reduce the demand signal to boiler B until the output signal from difference unit 60B is at neutral.

If after a predetermined length of time, in the order of one to five minutes, transfer of load from one boiler to the other is unable to satisfy total boiler demand, the unit load demand is reduced to be equal to the actual capabilities of the two boilers. An unsatisfied demand on boiler A, indicated by a sustained output signal from difference unit 60A, is transmitted to a high signal selector 72, whence after a predetermined time delay, as set in time delay unit 73, runs back the unit load demand generated by the load dispatch system 28 to be compatible with the total capabilities of the two boilers. To this unit is also transmitted the output signal from difference unit 60B indicative of a sustained unsatisfied demand to boiler B. As evident, the high signal selector 72 serves to pass to the unit load dispatch system 28 the higher of the two error signals generated in difference units 60A and 60B. Accordingly, if the larger of the two signals indicating an unsatisfied demand on either boiler, from either difference unit 60A or 60B is reduced to zero by running back the unit load demand, the unsatisfied demand on both boilers will be reduced to zero.

FEEDWATER CONTROL (FIG. 5)

In the usual arrangement of single boiler — single turbine, feedwater temperature varies in a direct predictable functional relation to unit load. With the two boiler — single turbine arrangement such is the case so long as the two boilers are in operation at identical loads. This relationship is destroyed, however, whenever the two boilers operate at different loads, as feedwater temperature is a function of turbine load. The relationship between feedwater temperature and actual steam flow entering the turbine, which in turn is equivalent to total feedwater flow to both boilers is directly related to the total turbine extraction flow to high and low pressure and deaerating feedwater heaters. Thus a lower feedwater temperature than that to be expected for the existing boiler demand has a direct relationship to the existing lower steam flow to the turbine which in turn is equivalent to a lower required boiler feedwater flow. Thus if the feedwater temperature is higher than that to be expected for the then existing boiler demand, the feedwater demand will be increased to reflect the actual increase in steam flow to the turbine that results from the increased extraction flow.

In the control, shown in FIG. 5, the rate of flow of feedwater to each boiler is maintained in direct proportion to boiler demand. Thus, the control signal generated in ratio control 32 is transmitted to feedwater control valve 74A. A feed back loop comprising flow transmitter 76A, difference unit 78A, integrating unit 80A and multiplying unit 82A maintains the actual feedwater flow equal to demand feed-water flow.

To provide for a departure in actual feedwater temperature from that to be expected for the then existing boiler demand, the signal generated by function generator 83A, corresponding to the expected feedwater temperature, is compared to a signal generated by a temperature transmitter 84A, corresponding to actual feedwater temperature, in a difference unit 86A. The output signal from difference unit 86A is transmitted to a multiplying unit 87A through a summing unit 88A and modifies the demand control signal in accordance with deviations in actual feedwater temperature from that to be expected for the then existing boiler demand.

Also affecting the desired rate of feedwater flow for a given boiler demand are changes which may be made in steam temperature set point from normal or design set point. Thus an increase in desired steam temperature from normal should effect a decrease in the rate of feedwater flow and vice versa. A control signal corresponding to changes in steam temperature set point, generated in unit 90A, modify the output of summing unit 88A to effect the desired compensation. While we have illustrated and described the feedwater control for boiler A, it is to be understood that that for boiler B is in all respects identical with that of boiler A.

FIRING RATE CONTROL (FIG. 6)

The demand signals to boilers A and B are measures of the heat release required of the boilers to satisfy the energy output demanded of the power producing unit. The head release is directly related to the fuel BTU input to the boiler furnace. The boiler demand signal thus adjusts fuel flow in parallel with air flow. It is recognized that for a given fuel and fuel BTU input the required combustion air flow remains essentially constant. Since the boiler demand signal is directly equated to energy output demanded and since the total cycle efficiency at each load is relatively constant and predictable our invention matches air flow directly to the boiler demand. Fuel flow is readjusted as required to maintain the superheater outlet temperatures of the two boilers equal and at turbine throttle temperature set point.

Figure 6:
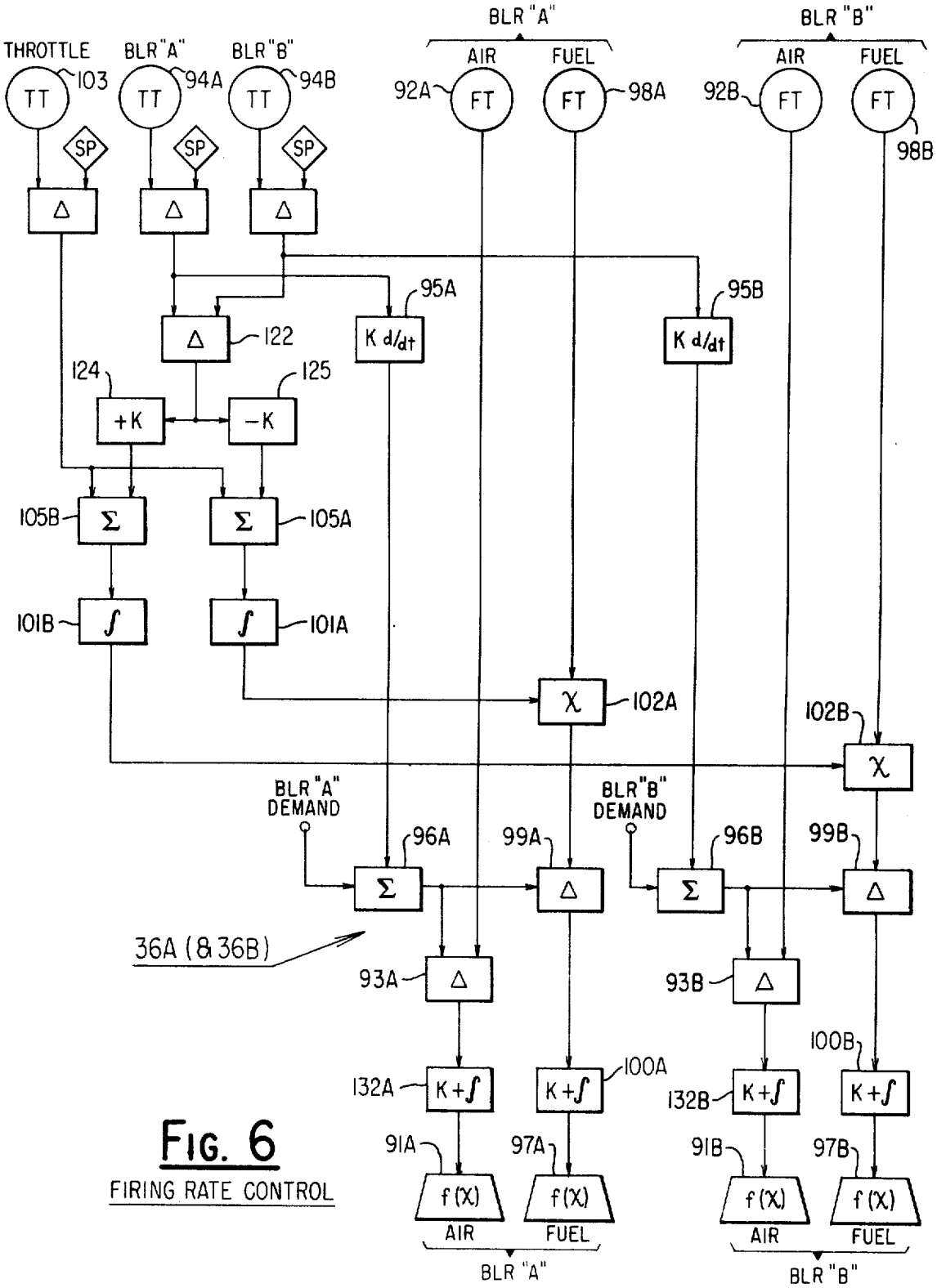
FIG. 6 is a logic diagram showing in detail the firing rate control (fuel and air control) for each of the steam generators A and B identified in FIG. 3 by blocks 36A and 36B respectively.

In accordance with the foregoing description, as shown in FIG. 6, the boiler A demand signal is transmitted to final control element 91A, such as a damper drive unit, controlling the rate of flow of air supplied for combustion. A feedback signal generated in flow transmitter 92A, proportional to measured air flow, maintains actual air flow equal to desired air flow. The signal generated in transmitter 92A is transmitted to difference unit 93A, and the output signal through a proportional plus integral unit 132A serves to adjust the air flow damper 91A as required to maintain actual air flow equal to desired air flow.

A signal proportional to temperature error from set point and to the rate of change in superheater outlet temperature of boiler A is superimposed upon the demand signal in a sense opposite the direction of temperature change thereby compensating for momentary fluctuations in superheater outlet temperature. As shown, a signal corresponding to superheater outlet temperature is generated in temperature transmitter 94A and transmitted to a proportional plus derivative unit 95A and thence to summing unit 96A.

The demand signal to boiler A, modified in accordance with the rate of change in superheater outlet temperature, also controls the rate of fuel flow to maintain the rate of fuel flow in required relationship to the rate of air flow. As shown, the output signal from summing unit 96A is transmitted to final control element 97A, shown in FIG. 2A as a fuel control valve, the specific type of fuel flow control device employed depending upon the type of fuel. A feedback loop comprising fuel flow transmitter 98A, difference unit 99A and proportional plus integral unit 100A maintains actual rate of fuel flow equal to the demand rate of fuel flow.

Relatively long term changes in turbine throttle temperature indicative of a change, for example, in the BTU content of the fuel effect a change in the ratio between the rate of flow of air and rate of flow of fuel, thus in effect automatically and continuously calibrating the rate of fuel flow to the rate of air flow. This is accomplished by introducing the signal generated in turbine throttle temperature transmitter 103 into integral unit 101A, the output signal from which is transmitted to a multiplying unit 102A. The output signal from multiplying unit 102A thus serves to modify the feedback signal from fuel flow transmitter 98A in accordance with long term changes in turbine throttle temperature which are, inferentially, a measure of changes in the relationship between the rate of fuel flow and rate of heat input to the boiler.

While the firing rate control so far described is specific to the control for boiler A, reference to FIG. 6 will show that the control for boiler B is identical, like components being indicated by the same number followed by the letter — B —.

To avoid interaction, or hunting as it is commonly called, between the superheater outlet temperatures of the two boilers while maintaining the desired turbine throttle temperature, in FIG. 6 we show additionally a push-pull control arrangement whereby the rate of fuel flow to the boiler having the higher superheater outlet temperature is decreased and simultaneously the rate of fuel flow to the other boiler is increased, thus maintaining the superheater outlet temperatures equal while adjusting, concurrently, the rate of fuel flow to both boilers in accordance with deviations in throttle steam temperature from set point. As shown, a signal proportional to the difference between boiler A and boiler B superheater outlet temperatures is generated in a difference unit 122 and through a direct acting proportional unit 124 and a reverse acting proportional unit 125 is transmitted to summing units 105A and 105B to bias the input signals to integral units 101A and 101B in opposite directions.

REHEAT FLOW CONTROL (FIG. 7)

Out invention comprehends proportioning the reheat steam from high pressure turbine 9 between boilers A and B in accordance with a feed forward signal derived from the demand signal to each boiler, thus, inferentially maintaining a reheat flow to each boiler proportional to primary steam generation. In FIG. 7 the demand signal to boiler A positions final control element, a flow control valve, 107A. Similarly, the demand signal to boiler B positions flow control valve 107B. By means of function generators 108A and 108B any desired linear or non-linear functional relationship between demand signal and the reheat flow to boiler A and B respectively can be programmed. Proper distribution of total available reheat flow is obtained by means of a push-pull feedback control loop whereby an equal difference between the actual reheat flow and programmed reheat flow through each boiler is maintained. As shown, reheat flow through boiler A and boiler B is measured by flow transmitters 109A and 109B respectively. While, for simplicity, in FIG. 1, the primary elements of the reheat flow transmitters are shown schematically as orifices, our invention comprehends the use of any pressure drop varying in functional relationship with respect to flow, thus, to minimize unrecovered pressure loss the pressure drop through the reheater may be used, or a primary element such as a Venturi Tube or flow nozzle. Known flow measuring means other than the type producing a pressure differential varying with flow might also be used. Further, as is well known, both pressure and temperature of the reheat steam vary with reheat flow and the flow transmitters can be compensated for both these conditions by any suitable means.

The difference between actual reheat flow and programmed reheat flow through each boiler is determined by difference units 110A and 110B. By way of example, an actual reheat flow greater than the programmed reheat flow may be considered as generating a positive output signal from difference unit 110A or 110B and vice versa. The generated signals are transmitted to a difference unit 111. The output signal generated therein through proportional plus integral unit 112, reverse and direct acting proportional unit 113A. 113B inputs to summing units 114A and 114B respectively. The output signals from summing units 114A and 114B are thus modified in opposite directions to position valves 107A and 10B in opposite directions to maintain equal differences between the actual reheat flows and programmed reheat flows. It is evident, if desired, the amount of readjustment allowed to maintain equal differences may be limited.

By the proper distribution of total reheat flow between the two boilers, as described, desired reheat temperature can be obtained by gas recirculation as shown in FIG. 1 supplemented, if required, by spray attemperation or other well known means. In the event, however, the hot reheat temperature of a boiler exceeds set point, our invention comprehends increasing the reheat flow to that boiler while simultaneously decreasing the flow to the other; or if the hot reheat temperatures of both boilers exceed set point to increase the reheat flow to that boiler having the greater excess while simultaneously decreasing the reheat flow through the other boiler.

This action thus tending to maintain the excess hot reheat temperatures from both boilers equal.

Temperature transmitters 115A and 115B generate signals corresponding to the hot reheat temperatures of boilers A and B. These signals are compared in high signal selecting units 116A and 116B against set point signals. So long as the signal generated in transmitter 115A, for example, is less than set point unit 116A transmits the set point signal to a difference unit 117. When, however, the signal corresponding to hot reheat temperature exceeds the set point signal, it is transmitted to difference unit 117. Similarly, so long as the signal generated by transmitter 115B is below set point, the signal transmitted to difference unit 117 will be the set point signal, if, however, the signal generated in transmitter 115B is greater than the set point signal it will be transmitted to difference unit 117. From the foregoing it is evident that the output signal from difference unit 116 will have a neutral value, such as zero, as long as both hot reheat temperatures are at or below set point. When, however, the hot reheat temperature of one boiler exceeds set point, unit 117 generates a signal in one sense, whereas if the hot reheat temperature of the other boiler exceeds set point, unit 117 will generate a signal in opposite sense. If the hot temperatures of both boilers exceed set point, then unit 117 will generate an output signal having a sense, dependent upon which boiler has the greater hot reheat temperature and will have a value corresponding to the difference between the two hot reheat temperatures.

The signal generated in difference unit 117 is transmitted to a direct acting proportional unit 118A and a reverse acting proportional unit 118B. These units through summing units 120A and 120B serve to modify the feed forward signals for boilers A and B in opposite senses, thus effecting a positioning of valves 107A and 107B in opposite directions, thus tending to maintain the hot reheat temperatures from both boilers below set point and further to maintain equal hot reheat temperatures from both boilers when both such temperatures are above set point.

An alternate arrangement, especially applicable if reheater absorption to load characteristic is such that reheat attemperators are seldom used and the two boilers are operated frequently with unbalanced steam flow and thus unbalanced reheater outlet temperature is to maintain reheater temperature control capability by biasing steam flow through the reheaters at all times a temperature difference occurs at the outlet of the two reheaters either above or below set point. To accomplish this, as shown in FIG. 7A, the high auctioneers 116A and 116B are replaced by difference units 130A and 130B developing a reheater outlet temperature error from set point for comparison in difference unit 117. Whenever either reheater outlet temperature error differs from the comparable error from the other boiler, the reheater steam flow will be increased through the reheater having the higher outlet temperature.

We claim:

1. In a feedwater control system for a steam generator, the combination comprising, means generating a feedwater demand signal, means responsive to said signal maintaining the rate of feed water flow in proportion to the magnitude of said demand signal, a function generator responsive to said demand signal generating a first signal varying in functional relationship with said demand signal and corresponding to the expected feedwater temperature, means generating a second signal corresponding to the actual feedwater temperature, a difference unit generating a third signal proportional to the difference between said first and second signals and means responsive to said third signal generating a modified feedwater demand signal to thereby adjust the feedwater flow in accordance with the difference between the expected and actual feedwater temperatures.

2. A control system as set forth in claim 1, further including means for modifying said third signal in accordance with steam temperature set point adjustments.

3. A feed water control system as set forth in claim 1, wherein said third signal generates a modified feed water demand signal decreasing the rate of flow of feed water in functional relationship to decreases in the actual feed water temperature and vice versa.

4. In a feed water control system for a two boiler-single turbine power producing unit wherein the two boilers are provided with feed water comprised of condensate from the turbine heated by a feed water heater supplied with extraction steam from the turbine, the combination comprising, means generating a first primary feed water demand signal for one of said boilers and a second primary feed water demand signal for the other of said boilers, means varying the rate of flow of feed water to said one boiler in functional relationship to changes in the value of said first primary demand signal, means modifying the rate of flow of feed water to said one boiler in accordance with deviations in actual feed water temperature from expected feed water temperature for the then existing value of said first primary demand signal, means varying the rate of flow of feed water to the other of said boilers in functional relationship to changes in the value of said second demand signal and means modifying the rate of flow of feed water to the other of said boilers in accordance with deviations in actual feed water temperature from expected feed water temperature for the then existing value of said second primary demand signal.

5. A feed water control system as set forth in claim 4. wherein each of said modifying means decreases the rate of flow of feed water in functional relationship to decreases in actual feed water temperataure and vice versa.

6. A control system as set forth in claim 5, further including means for modifying the rate of flow of feed water to each of said boilers in accordance with steam temperature set point adjustments.

* * * * *